US007365260B2

(12) United States Patent
Kawashima

(10) Patent No.: US 7,365,260 B2
(45) Date of Patent: Apr. 29, 2008

(54) APPARATUS AND METHOD FOR REPRODUCING VOICE IN SYNCHRONISM WITH MUSIC PIECE

(75) Inventor: Takahiro Kawashima, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 432 days.

(21) Appl. No.: 10/738,584

(22) Filed: Dec. 16, 2003

(65) Prior Publication Data

US 2004/0133425 A1 Jul. 8, 2004

(30) Foreign Application Priority Data

Dec. 24, 2002 (JP) ..... 2002-371750

(51) Int. Cl.
*G10H 1/00* (2006.01)

(52) U.S. Cl. ..... 84/600; 84/609; 84/647; 704/258; 704/260; 704/266

(58) Field of Classification Search ..... 84/600–602, 84/609, 647, 649; 704/258, 260, 266, 268
See application file for complete search history.

(56) References Cited

U.S. PATENT DOCUMENTS 4,731,847 A * 3/1988 Lybrook et al. ..... 704/260
5,235,124 A * 8/1993 Okamura et al. ..... 434/307 A
5,703,311 A * 12/1997 Ohta ..... 84/622
5,806,039 A * 9/1998 Fukada et al. ..... 704/268
6,304,846 B1 * 10/2001 George et al. ..... 704/270
6,321,179 B1 11/2001 Glance et al. ..... 702/189
6,327,590 B1 12/2001 Chidlovskii et al. ..... 707/5
6,424,944 B1 * 7/2002 Hikawa ..... 704/260
6,459,774 B1 * 10/2002 Ball et al. ..... 379/67.1
6,694,297 B2 * 2/2004 Sato ..... 704/276
6,782,299 B1 8/2004 Tsuji et al.

(Continued)

FOREIGN PATENT DOCUMENTS

EP 1330101 7/2003

(Continued)

OTHER PUBLICATIONS

Cakewalk Pro Audio 9: User's Guide. 1999. See pp. 7-8, 7-9, 7-21 and 7-31, no month.*

(Continued)

*Primary Examiner*—Lincoln Donovan
*Assistant Examiner*—David S. Warren
(74) *Attorney, Agent, or Firm*—Morrison & Foerster LLP

(57) ABSTRACT

Music piece sequence data are composed of a plurality of event data which include performance event data and user event data designed for linking a voice to progression of a music piece. A plurality of voice data files are stored in a memory separately from the music piece sequence data. In music piece reproduction, the individual event data of the music piece sequence data are sequentially read out, and a tone signal is generated in response to each readout of the performance event data. In the meantime, a voice reproduction instruction is output in response to each readout of the user event data. In accordance with the voice reproduction instruction, a voice data file is selected from among the voice data files stored in the memory, and a voice signal is generated on the basis of each read-out voice data.

19 Claims, 7 Drawing Sheets

U.S. PATENT DOCUMENTS

| | | | | |
|---|---|---|---|---|
| 6,928,410 | B1 * | 8/2005 | Marila et al. | 704/268 |
| 7,058,889 | B2 * | 6/2006 | Trovato et al. | 715/716 |
| 2001/0027396 | A1 * | 10/2001 | Sato | 704/260 |
| 2003/0200858 | A1 * | 10/2003 | Xie | 84/609 |
| 2003/0212559 | A1 * | 11/2003 | Xie | 704/260 |
| 2004/0014484 | A1 * | 1/2004 | Kawashima | 455/550.1 |

FOREIGN PATENT DOCUMENTS

| | | |
|---|---|---|
| JP | 62-137082 | 8/1987 |
| JP | 62-194390 | 12/1987 |
| JP | 2002-311967 | 10/2002 |
| JP | 2002-334261 | 11/2002 |
| WO | WO-99/40566 | 8/1999 |

OTHER PUBLICATIONS

J.M. Kleinberg, "Authoritative Sources in a Hyperlinked Environment", IBM Research Report RJ 10076, May 1997, pp. 1-33.

"*SMAF Guide Book*", Monthly DTM magazine, March issue, p. 9, item "Audio Track".

* cited by examiner

APPARATUS AND METHOD FOR REPRODUCING VOICE IN SYNCHRONISM WITH MUSIC PIECE

BACKGROUND OF THE INVENTION

The present invention relates to an improved voice/music piece reproduction apparatus and method for reproducing a particular voice sequence at designated timing within a music piece sequence.

In the field of mobile or portable phones (e.g., cellular phones) and the like today, it has been known to perform visual display and voice (e.g., human voice) reproduction in synchronism with a music piece. Japanese Patent Application Laid-open Publication No. 2002-101191 discloses a technique for audibly reproducing a music piece and voices in synchronism at predetermined timing.

Also, as an example of the technique for audibly reproducing voices (e.g., human voices) in synchronism with a music piece, there has been known a method, in accordance with which both a music piece sequence and a voice sequence are defined in a single sequence file so that a music piece and voices are audible reproduced by reproducing the sequence file. FIG. 13 is a block diagram schematically showing a general setup of a conventional voice/music piece reproduction apparatus for practicing the method. In the conventional voice/music piece reproduction apparatus, a voice-added music piece data file 51 is loaded into sound middleware 53 by a player 52, and the sound middleware 53 interprets the loaded file to generate music-piece reproducing sound source control data and voice reproducing sound source control data and outputs these generated sound source control data to a sound source unit 54. The sound source unit 54 includes a music-piece reproducing sound source and a voice reproducing sound source, and the sound source unit 54 mixes tone and voice signals reproduced by the respective sound sources and outputs the mixed result to a speaker 55.

The voice sequence included in the voice-added music piece data file includes time information indicative of generation timing of individual voices to be audibly reproduced or sounded, and the voice sequence can be synchronized with the music piece sequence in accordance with the time information. Thus, when editing the voice-added music piece data file or revising reproduced contents of the voice sequence, the conventional voice/music piece reproduction apparatus must edit or revise given portions while interpreting the time information of the two sequences to confirm synchronization between the voices and the music piece, so that the editing or revision would require a considerable time and labor. Further, where a plurality of reproduction patterns differing only in to-be-reproduced voices are necessary, a same music piece sequence must be prepared in correspondence with the respective to-be-reproduced voices, which would result in a significant waste in terms of a data size particularly in small-size equipment, such as portable phones.

SUMMARY OF THE INVENTION

In view of the foregoing, it is an object of the present invention to provide an improved voice/music piece reproduction apparatus, method and program and improved sequence data format which allow a voice sequence to be edited or revised with ease and can avoid a waste of a data size.

In order to accomplish the above-mentioned object, the present invention provides a voice/music piece reproduction apparatus, which comprises: a first storage section storing music piece sequence data composed of a plurality of event data, the plurality of event data including performance event data and user event data designed for linking a voice to progression of a music piece; a second storage section storing a plurality of voice data files; a music piece sequence reproduction section that sequentially reads out the individual event data of the music piece sequence data from the first storage section, a voice reproduction instruction being outputted in response to readout, by the music piece sequence reproduction section, of the user event data; a musical sound source section that generates a tone signal in accordance with the performance data read out by the music piece sequence reproduction section; a voice reproduction section that, in response to the voice reproduction instruction outputted by the music piece sequence reproduction section, selects a voice data files from among the voice data files stored in the second storage section and sequentially reads out voice data included in the selected voice data file; and a voice sound source section that generates a voice signal on the basis of the voice data read out by the voice reproduction section.

With such arrangements, voice data can be reproduced easily at predetermined timing in a progression of a music piece. Also, the inventive arrangements allow a voice data reproducing sequence, synchronized with the progression of the music piece, to be revised, edited, etc. with ease. The voice reproduction instruction may include information specifying a voice data file to be selected from among the voice data files stored in the second storage section. Further, desired voice data contents may be created in response to user's input operation, and a voice data file composed of the thus-created voice data contents may be written in the second storage section. Thus, in a manner original to each individual user, the necessary processing to be performed by the apparatus can be programmed with utmost ease such that the voice data are reproduced at predetermined timing in a progression of a music piece. This arrangement should be very advantageous and convenient for an ordinary user having no or little expert knowledge of music piece sequence data in that, where the present invention is applied to a portable phone or other portable terminal equipment, it. allows a music piece and voices to be linked together in a manner original to the user.

The present invention also provides a method for reproducing a voice and music piece using a storage medium storing music piece sequence data composed of a plurality of event data and a plurality of voice data files, the plurality of event data including performance event data and user event data designed for linking a voice to progression of a music piece, and the method comprises: a music piece sequence reproduction step of sequentially reading out the individual event data of the music piece sequence data from the storage medium, and outputting a voice reproduction instruction in response to readout of the user event data; and a voice reproduction step of, in response to the voice reproduction instruction outputted by the music piece sequence reproduction step, selecting a voice data files from among the voice data files stored in the storage medium and sequentially reading out voice data included in the selected voice data file. In the method, a tone signal is generated in accordance with the performance event data read out by the music piece sequence reproduction step, and a voice signal is generated on the basis of the voice data read out by the voice reproduction step.

The present invention also provides a program containing a group of instructions for causing a computer to perform the above voice/music piece reproduction method.

The present invention also provides a novel and useful format of voice/music piece reproducing sequence data, which comprises: a sequence data chunk including music piece sequence data composed of a plurality of event data that include performance event data and user event data; and a voice data chunk including a plurality of voice data files. According to the inventive format, the user event data is designed for linking a voice to progression of a music piece, and to the user event data is allocated a voice data file to be reproduced at generation timing of the user event, the voice data file to be reproduced at generation timing being selected from among the plurality of voice data files included in the voice data chunk.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE EMBODIMENTS

Figure 1:
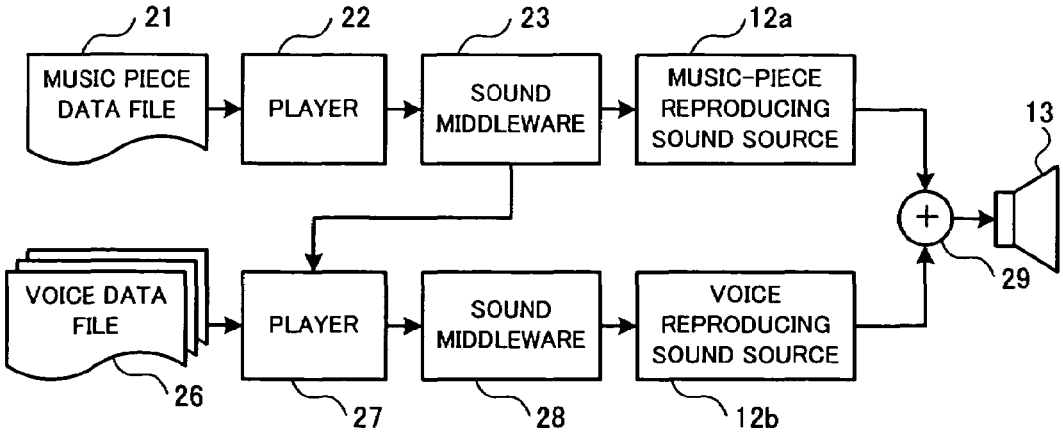
FIG. 1 is a functional block diagram of a voice/music piece reproduction apparatus in accordance with an embodiment of the present invention.
Figure 2:
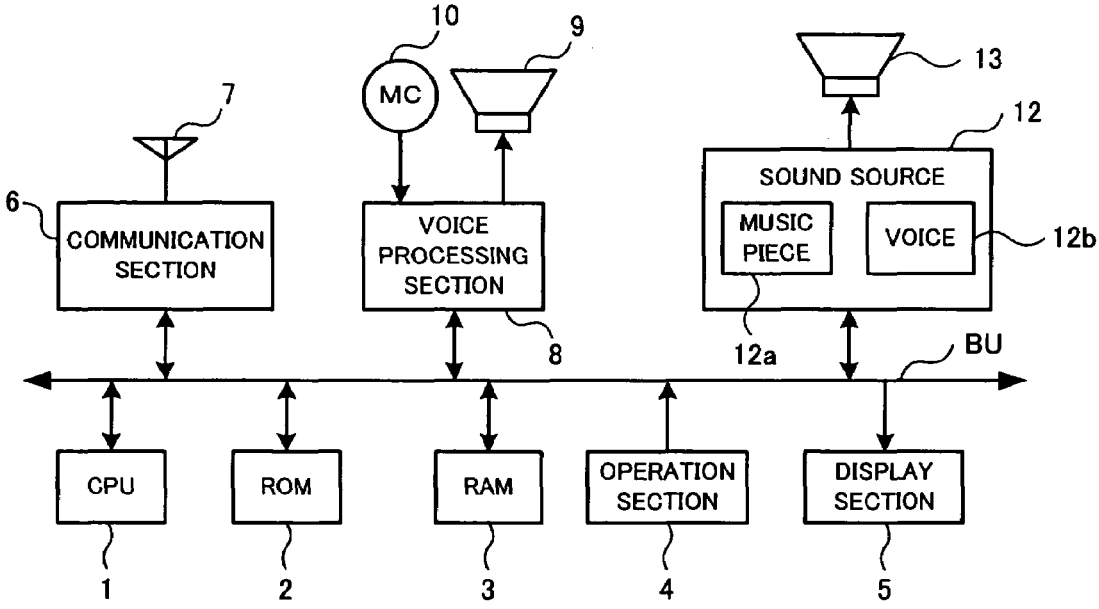
FIG. 2 is a block diagram showing a general setup of a portable phone to which is applied the embodiment of the voice/music piece reproduction apparatus.

FIG. 1 is a functional block diagram of a voice/music piece reproduction apparatus in accordance with an embodiment of the present invention, and FIG. 2 is a block diagram showing a general hardware setup of a portable phone (e.g., cellular phone) to which is applied the voice/music piece reproduction apparatus. In FIG. 2, reference numeral 1 represents a CPU (Central Processing Unit), 2 represents a ROM (Read-Only Memory) having stored therein programs to be executed by the CPU 1, and 3 represents a RAM (Random Access Memory) for temporarily storing data; in the illustrated example, the RAM is in the form of a nonvolatile memory. Reference numeral 4 represents an operation section including a numeric keypad and function keys, 5 a display section in the form of an LCD (Liquid Crystal Display), and 6 a communication section that communicates with a base station via an antenna 7.

Reference numeral 8 represents a voice processing section, which decompresses compressed voice data output from the communication section 6 and converts the voice data into an analog signal to supply the converted analog signal to a speaker 9. The voice processing section 8 also converts a voice signal picked up by a microphone 10 into digital voice data and compresses the digital voice data to supply the compressed digital voice data to the communication section 6. Reference numeral 12 represents a sound source unit, which includes a music-piece reproducing sound source 12*a* and a voice reproducing sound source 12*b*. In the illustrated example, the music-piece reproducing sound source 12*a* is designed to generate a tone signal using the FM or PCM scheme, and the voice reproducing sound source 12*b* synthesizes a voice (e.g., human voice) using the waveform convolution scheme or formant synthesis scheme. Incoming call signaling melody (ring melody) is produced by the music-piece reproducing sound source 12*a*, and a tone imparted with voices (voice-added tone) is reproduced by both of the music-piece reproducing sound source 12*a* and voice reproducing sound source 12*b*. Note that, unless specified otherwise, the term "voice" as used herein typically refers to a human voice, such as a singing voice, humming or narrative voice; however, the term "voice" also refers to an artificially-made special voice, such as a voice of an animal or robot.

As shown in FIG. 1, a music piece data file 21 is stored in the RAM 3. The music piece data file 21 contains music piece data sets to be used as incoming call signaling melodies, music piece data sets of music pieces to be listened to for enjoyment. Each of the music piece data sets included in the music piece data file 21 can be downloaded via the Internet. Specifically, the music piece data file 21 is composed of event data indicative of various control events, such as tone generating instructions, to be applied to the music-piece reproducing sound source 12*a* and time data indicative of respective generation timing of the events. Further, in the instant embodiment, the music piece data file 21 includes user event data instructing that predetermined voice data (e.g., data indicative of human voices) should be loaded from the RAM 3. Generation timing of the user event data too is set by the above-mentioned time data. Player 22 is software that functions to load the music piece data within the music piece data file 21 into sound middleware 23 and control the music piece data file 21 in accordance with an instruction from a user. The sound middleware 23 is also software that functions to convert music piece data, supplied from the player 22, into sound source control data and sequentially supply the converted sound source control data to the music-piece reproducing sound source 12*a* of the sound source sound source unit 12 (FIG. 2) in accordance with the time data. The music-piece reproducing sound source 12*a* converts the sound source control data into tone signals.

Further, in FIG. 1, each of a plurality of voice data files 26 has voice data recorded therein and is stored in the RAM 3. Player 27 loads one of the voice data files 26, the file number of which is designated by the sound middleware 23, to sound middleware 28. The sound middleware 28 sequentially outputs individual voice data within the voice data file, supplied from the player 27, to the voice reproducing sound source 12*b* of the sound source unit 12. The voice reproducing sound source 12*b* converts the supplied voice data into analog voice signals. The tone and voice signals output from the music-piece reproducing sound source 12*a* and voice reproducing sound source 12*b* are synthesized by a synthesis section 29 and supplied to a speaker 13.

Next, operation of the instant embodiment of the voice/music piece reproduction apparatus will be described with reference to a flow chart and diagram of FIGS. 3 and 4. The primary telephony function of the portable phone, to which the present invention is applied, is the same as that of the conventional portable phones and thus will not be described here.

Figure 3:
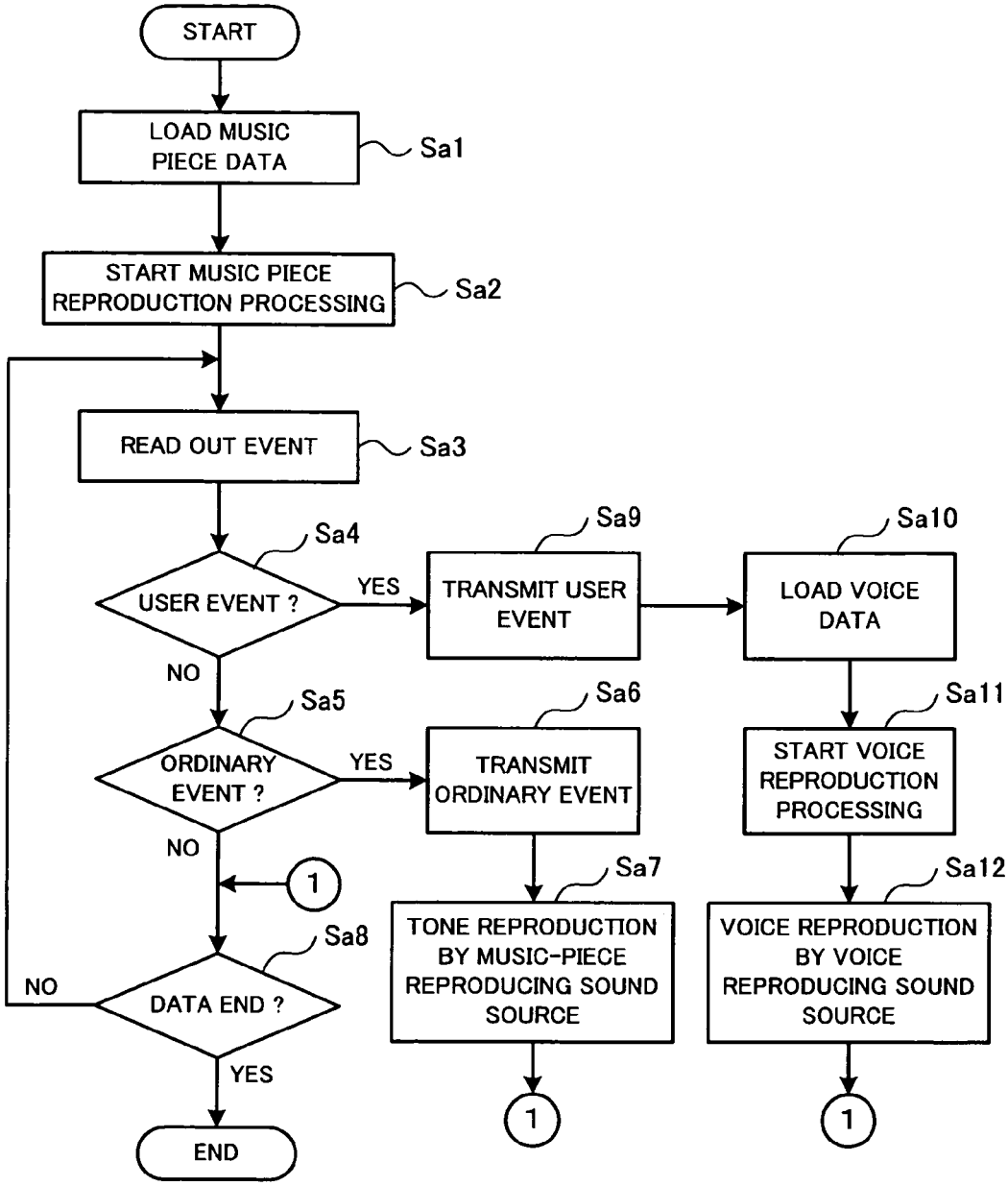
FIG. 3 is a flow chart explanatory of operation of the embodiment of the voice/music piece reproduction apparatus.

Once the user designates a desired music piece by entering a unique music piece number of the music piece and instructs music piece reproduction on the operation section 4, the player 22 reads out the music piece data of the designated music piece from the music piece data file 21 and loads the read-out music piece data into the sound middleware 23, at step Sa1 of FIG. 3. Then, the sound middleware 23 starts music piece reproduction processing based on the loaded music piece data, at step Sa2. First of all, the first event data is read out at step Sa3, and it is determined at step Sa4 whether or not the read-out event data is one representative of a user event. If the read-out event data does not represent a user event (NO determination at step Sa4), a further determination is made at step Sa5 as to whether or not the read-out event data is one representative of an ordinary event (i.e., music piece reproducing event). If the read-out event data represents an ordinary event (YES determination at step Sa5), the sound middleware 23 passes the event data to the music-piece reproducing sound source 12*a*, at step Sa6. In turn, the music-piece reproducing sound source 12*a* reproduces a tone signal on the basis of the event data, at step Sa7. Then, the sound middleware 23 determines at step Sa8 whether or not an end of the music piece data set has been detected. If answered in the negative at step Sa8, control reverts to step Sa3 to read out the next event data.

Reproduction of the desired music piece is carried out by repeating the above-mentioned steps. Once a user event is detected during the course of the music piece reproduction, i.e. once a YES determination is made at step Sa4, the sound middleware 23 sends the user event to the player 27, at step Sa9. Upon receipt of the user event, the player 27 loads a voice data file 26 of a file number, designated by the user event, into the sound middleware 28, at step Sa10. In turn, the sound middleware 28 starts voice reproduction processing at step Sa11 and sequentially outputs the loaded voice data to the voice reproducing sound source 12*b*. Thus, the voice reproducing sound source 12*b* carries out the voice reproduction at step Sa12.

After sending the user event to the player 27, the sound middleware 23 determines at step Sa8 whether or not the end of the music piece data set has been detected. If answered in the negative at step Sa8, control reverts to step sa3 to repeat the above operations.

Figure 4:
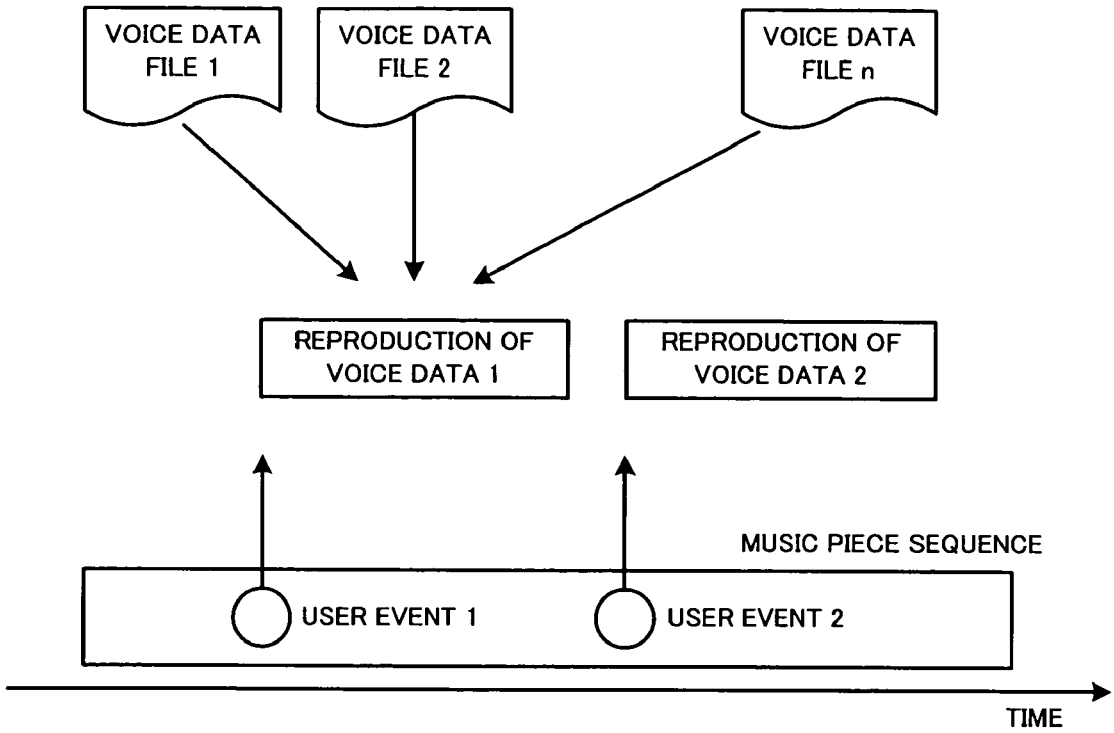
FIG. 4 is a diagram also explanatory of the operation of the embodiment of the voice/music piece reproduction apparatus.

FIG. 4 is a block diagram explanatory of the above operations, which particularly indicates that "voice data 1" is reproduced in response to detection of "user event 1" and then "voice data 2" is reproduced in response to detection of "user event 2". Note that the voice data file to be reproduced in response to a user event is specified by a file number that was selected previously by user's designation and written as a user event within the corresponding music piece data set via application software. Here, the application software may be prestored in the ROM 2 or may be made on the basis of JAVA (registered trademark).

Next, a description will be given about a first example of use or application of the above-described voice/music piece reproduction apparatus, with reference to a diagram and flow chart of FIGS. 5 and 6.

Figure 5:
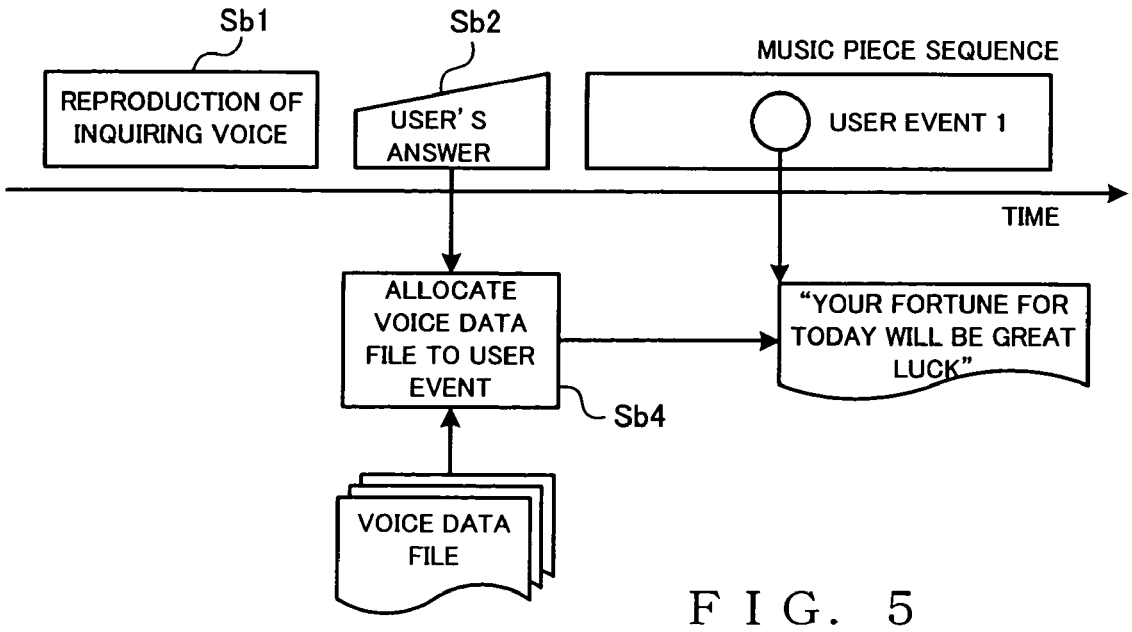
FIG. 5 is a diagram explanatory of a first example of application of the voice/music piece reproduction apparatus.
Figure 6:
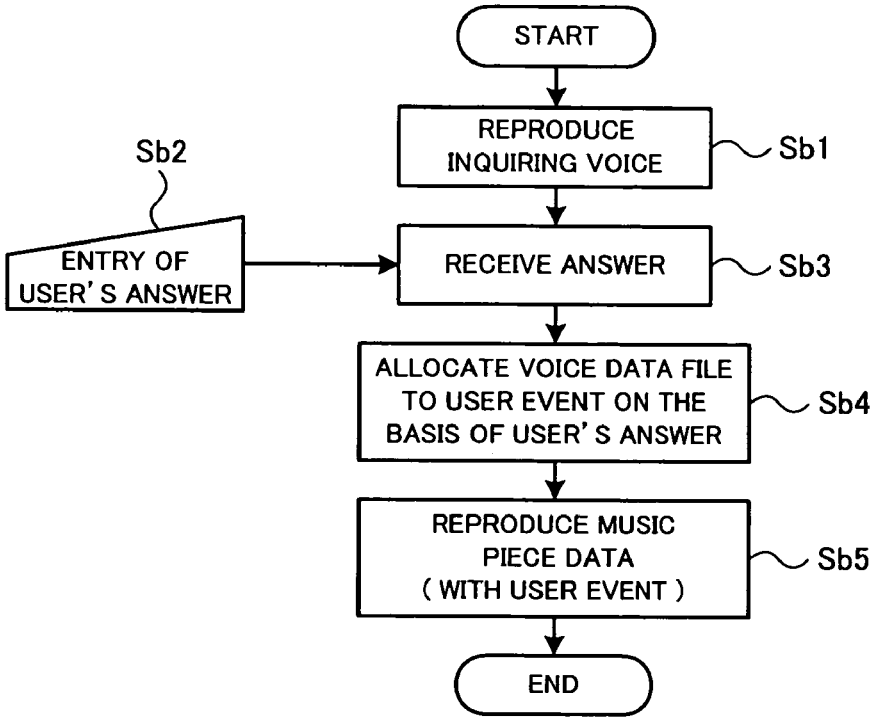
FIG. 6 is a flow chart also explanatory of the first example of application of the embodiment of the voice/music piece reproduction apparatus.

In the first example of application, once application software is started up, inquiring voice data is supplied to the voice reproducing sound source 12*b* so as to perform inquiring voice reproduction (step Sbl of FIGS. 5 and 6). For example, in the case of a quiz, inquiring voices, such as "Yes", "No", "A", "B" and "C", are reproduced. In the case of fortune-telling by blood type, inquiring voices, such as "A", "B", "AB", "B" and "O", are reproduced. Further, in the case of a horoscope, inquiring voices, such as "the Crab" and "the Lion" are reproduced. Once the user answers the inquiry using the numeric keypad of the operation section 4 at step Sb2, the application software receives the answer at step Sb3 and allocates the file number of the voice data file 26, indicated by the received answer, to a user event at step Sb4. Then, reproduction of the music piece data is carried out at step Sb5. If a user event is detected during the course of the music piece data reproduction, the voice data set allocated to the user event through the above operation are reproduced. For example, words "Your fortune for today will be great luck" are sounded to the music piece tones.

Figure 7:
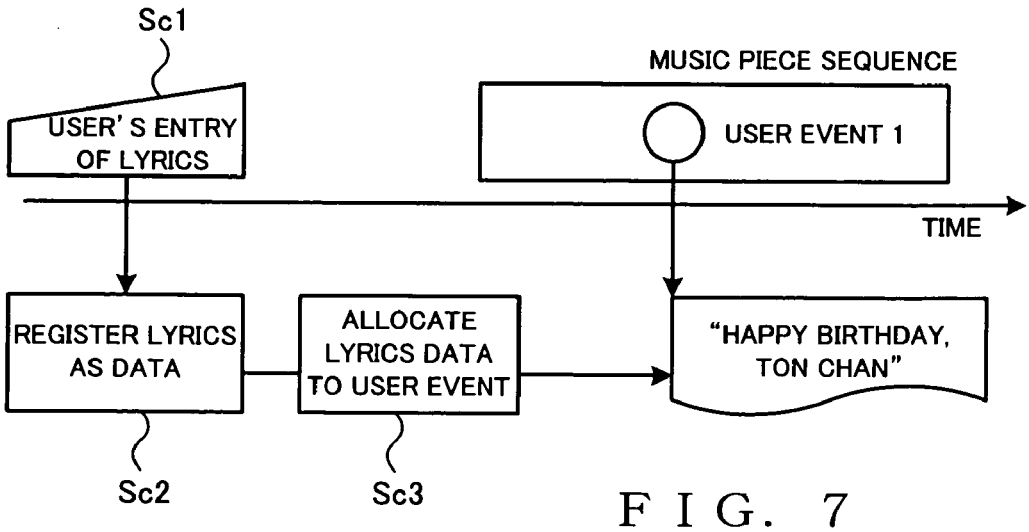
FIG. 7 is a diagram explanatory of a second example of application of the embodiment of the voice/music piece reproduction apparatus.
Figure 8:
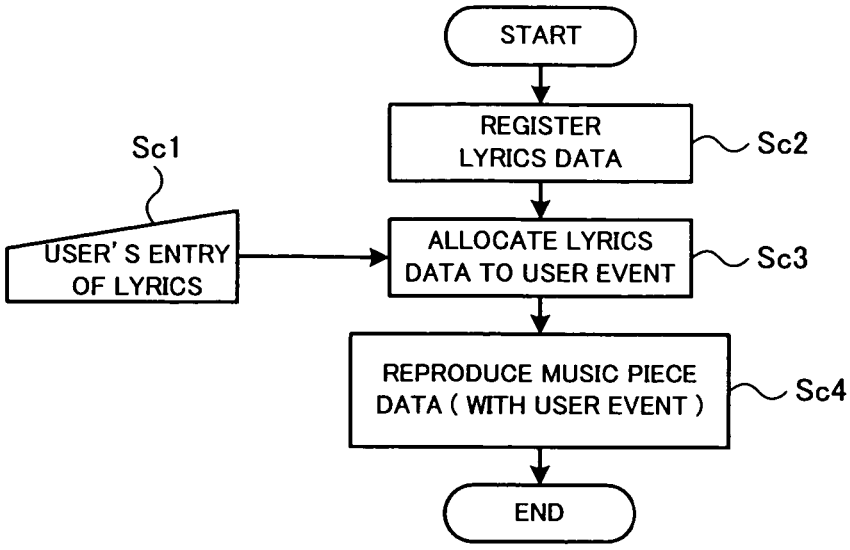
FIG. 8 is a flow chart also explanatory of the second example of application of the voice/music piece reproduction apparatus.

Next, a description will be given about a second example of application of the above-described voice/music piece reproduction apparatus, with reference to a diagram and flow chart of FIGS. 7 and 8.

In the second example of application, once application software is started up, entry of lyrics is requested on a screen display or the like. In response to the request, the user selects a particular music piece (in which one or more user events are preset) and uses the numerical keypad to enter text of original lyrics at particular timing within the music piece, at step Sc1 of FIGS. 7 and 8. Then, the application software converts the entered lyrics (one or more text) into voice data and registers the converted voice data in the RAM 3 as a voice data file 26, at step Sc2. After that, the application software allocates the file number of the voice data file 26 to the user event, at step Sc3. Note that the lyrics may be input and allocated to a plurality of portions (e.g., A melody portion, B melody portion, bridge portion, etc.) of the music piece in question rather than just one portion of the music piece.

Then, reproduction of a corresponding music piece data set is carried out at step Sc4. If a user event (having a file number of a voice data file allocated thereto) is detected during the course of the music piece data reproduction, then the voice data of the lyrics allocated to the user event through the above operations are reproduced. For example, words "Happy birthday, Ton chan!" are sounded to the music piece tones (FIG. 7).

Note that the original lyrics may be sounded with a melody imparted thereto, in which case tone pitches and tone lengths may be allocated to individual elements (syllables) of the lyrics, for example, in any of the following manners.

(1) When the lyrics (text) are registered, tags indicative of predetermined tone pitches and lengths are imparted to the text, and the sound source controls pitches and lengths to be reproduced in accordance with the tags at the time of reproduction.

(2) When the music piece sequence is reproduced, tone pitches and lengths of the melody following the detected user event are extracted, and simultaneously tones corresponding to syllables constituting the lyrics (text) are controlled to assume the tone pitches and lengths to thereby generate the thus-controlled tones.

Here, the application software employed in the first and second examples may be prestored in the ROM 2 or may be made on the basis of JAVA (registered trademark).

Next, a description will be given about a second embodiment of the present invention.

Figure 9:
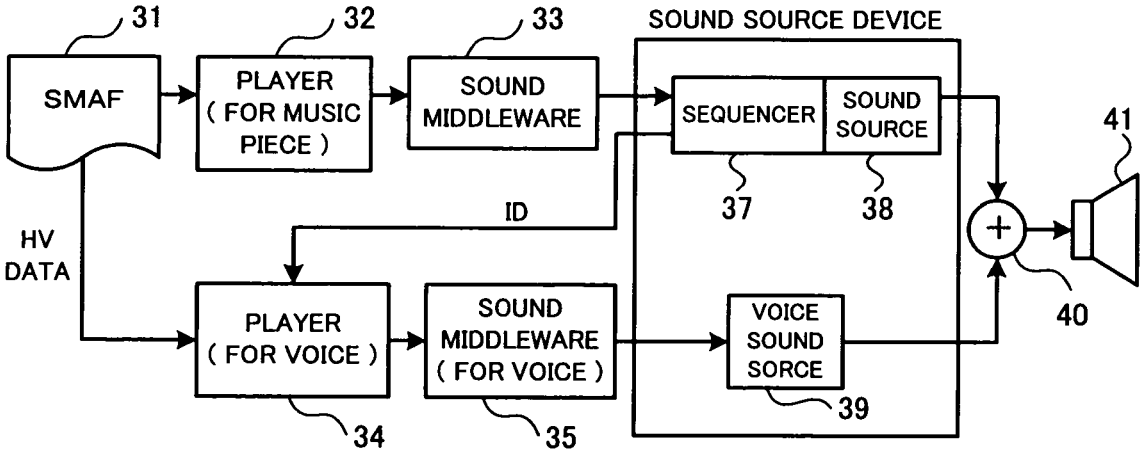
FIG. 9 is a functional block diagram of a voice/music piece reproduction apparatus in accordance with a second embodiment of the present invention.
Figure 10:
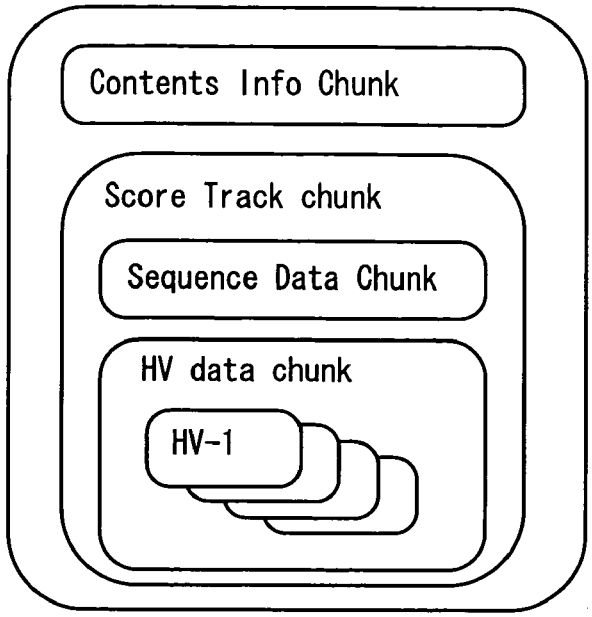
FIG. 10 is a diagram showing an organization of an SMAF file in the second embodiment.

FIG. 9 is a functional block diagram of a voice/music piece reproduction apparatus in accordance with the second embodiment of the present invention. In the figure, reference numeral 31 represents an SMAF (Synthetic music Mobile Application Format) file in the second embodiment. Here, the SMAF file is a file of a multimedia contents data format for portable terminals, and, in the instant embodiment, music piece data and voice data are written in a single SMAF file. FIG. 10 shows an organization of the SMAF file employed in the embodiment. In the illustrated example, there are used the following chunks (data blocks):

Contents Info Chunk storing various managing information of the SMAF file;

Score Track chunk storing a sequence track of a music piece to be supplied to a sound source;

Sequence Data Chunk storing actual performance data; and

HV Data chunk storing HV (voice) data HV-1, H-2, . . . .

Sequence of actual performance data includes "HV Note ON" events recorded therein, and sounding of each data in the HV Data chunk is specified by the "HV Note ON" event. Note that the "HV Note ON" event corresponds to the user event in the first embodiment.

Further, in FIG. 9, reference numeral 32 represents a music piece player, 33 sound middleware for a music piece, 34 a voice player, and 35 sound middleware for a voice. These functions are similar to those shown in FIG. 1. Reference numeral 36 represents a sound source device, in which there are provided a sequencer 37 for reproducing a music piece, a sound source 38 for generating a tone signal on the basis of sound source control data output from the sequencer 37 and a voice reproducing sound source 39. The tone signal and voice signal generated by the sound sources 38 and 39 are synthesized by a synthesis circuit 40 and supplied to a speaker.

Figure 11:
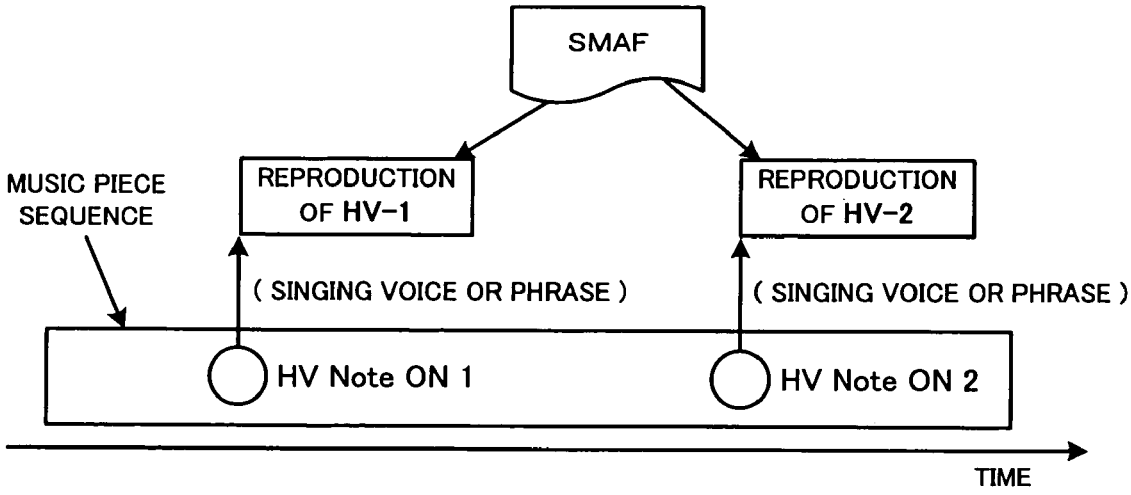
FIG. 11 is a diagram explanatory of operation of the second embodiment of the voice/music piece reproduction apparatus.

Next, operation of the second embodiment of the voice/music piece reproduction apparatus will be described with reference to a diagram and flow chart of FIGS. 11 and 12.

Figure 12:
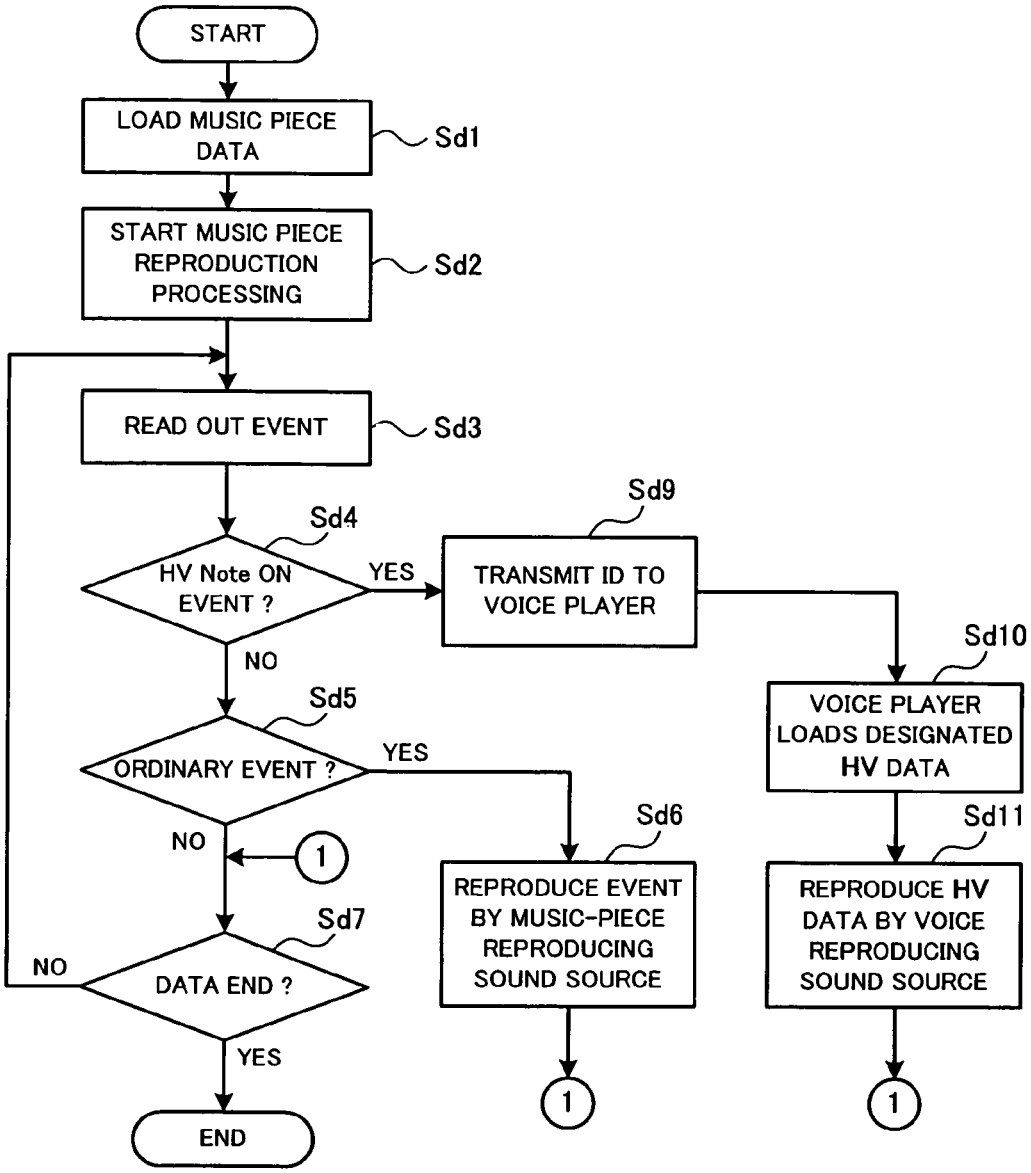
FIG. 12 is a flow chart also explanatory of the operation of the second embodiment of the voice/music piece reproduction apparatus.
Figure 13:
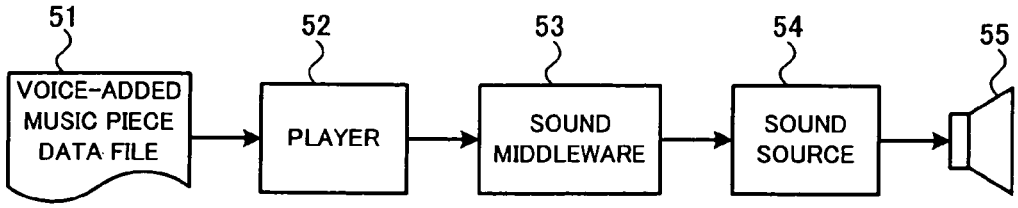
( PRIOR ART ) F I G. 1 3
FIG. 13 is a block diagram schematically showing a general setup of a conventional voice/music piece reproduction apparatus.

Once the user instructs reproduction of a desired music piece, the player 32 reads out the corresponding designated music piece data from the SMAF file 31 and loads the read-out music piece data into the sound middleware 33, at step Sd1 of FIG. 12. Then, the sound middleware 33 converts the loaded music piece data into sound source control data and outputs the converted sound source control data to the sequencer 37 (step Sd2: music piece reproduction start). The sequencer 37 reads out the first event data from among the sound source control data at step Sd3 and determines at step Sd4 whether or not the read-out event data is one representative of an HV Note On event. If the read-out event data does not represent an HV Note On event as determined at step Sd4, it is further determined at step Sd5 whether or not the read-out event data is one representative of an ordinary event (i.e., music piece reproducing event). If the read-out event data represents an ordinary event as determined at step Sd5, the sequencer 37 passes the event data to the sound source 38, so that the sound source 38 reproduces a tone signal on the basis of the event data at step Sd6. Then, the sequencer 37 determines at step Sd7 whether or not an end of the music piece data set has been detected. If answered in the negative at step Sd7, control reverts to step sd3 to read out next event data.

Reproduction of the desired music piece is carried out by repeating the above-mentioned steps. Once an HV Note ON event is detected during the course of the music piece reproduction, i.e. once a YES determination is made at step Sd4, the sequencer 37 sends an ID designating HV data assigned to the HV Note ON event, at step Sd9. In turn, the player 34 reads out, from the SMAF file, the HV data designated by the ID and loads the HV data into the sound middleware 35, at step Sd10. The sound middleware 35 converts the HV data into sound source control data (parameters for designating a voice) and outputs the converted sound source control data to the sound source 39. Thus, the sound source 39 carries out the voice reproduction at step Sd11.

After sending the HV Note ON event to the player 34, the sequencer 37 determines at step Sd7 whether or not the data end has been detected. If answered in the negative at step Sd7, control reverts to step sd3 to repeat the above operations. FIG. 11 is a block diagram explanatory of the above operations, which particularly indicates that, during the course of the music piece sequence, "voice data HV-1" is reproduced when "HV Note ON event 1" is detected and then "voice data HV-2" is reproduced when "HV Note ON event 2" is detected.

Similarly to the above-described first embodiment, the second embodiment can reproduce a music piece where a singing voice and/or narration is inserted.

The SMAF file is normally created by a contents maker and delivered to an interested user; however, if a user's portable terminal apparatus has a function to process the data of the SMAF file, the second embodiment permits use or application similar to the above-described second example of application.

One or more user event data within music piece sequence data are incorporated in advance in one or more positions (such as time positions and/or measure positions) of each individual music piece. With this arrangement, when the user performs operation to allocate desired voice data files, it is no longer necessary for the user to incorporate user events one by one into music pieces, which can significantly reduce burdens on the user. Namely, the user need not have detailed knowledge of the file structure of the music piece sequence data. The user only has to merely allocate desired voice data files in association with the previously-incorporated user events; alternatively, suitable voice data files are automatically allocated by application software. Therefore, when an amateur user, such as an ordinary user of a portable phone, having no or little expert knowledge of music piece sequence data, wants to freely incorporate original voices (e.g., human voices) in synchronism with music pieces, utmost ease of use or convenience an be achieved. Alternatively, one or more user event data may of course be freely incorporated by user's operation in corresponding relation to one or more desired positions within the music piece sequence data. In such a case, original voices can be incorporated at original timing in synchronism with music pieces.

As a modification, a plurality of voice data files may be allocated to one user event data so that the allocated voice data files can be reproduced sequentially (or simultaneously) with the timing of the user event data used as a start point of the reproduction.

Whereas the embodiments of the present invention have been described as reproducing voices in Japanese, voices in various other languages than Japanese, such as English, Chinese, German, Korean and Spanish, may be reproduced. Further, voices of animals in addition to or in place of human voices may be reproduced.

In summary, according to the present invention, a music piece data file including user events and voice data files whose reproduction is instructed by the user events are processed by respective reproduction sections. Thus, the present invention allows a voice sequence to be readily edited or revised as desired. Further, even in a case where a plurality of voice sequence patterns are to be prepared, it just suffice to prepare only a plurality of voice data files, so that the present invention can avoid a waste of a data size.

What is claimed is:

1. A voice/music piece reproduction apparatus comprising:

a first storage section storing a music piece sequence data file composed of a plurality of event data indicative of various control events and time data indicative of respective generation timing of the control events, the plurality of event data including musical performance event data and user event data;

a second storage section storing a plurality of voice data files;

an output section that outputs inquiry data to invite a user to answer an inquiry;

an allocation section that selects a voice data file from among the voice data files stored in the second storage section in accordance with an answer from the user, and allocates the selected voice data file to the user event data in the music piece sequence data file;

a music piece sequence reproduction section that starts reading out, in response to an instruction of music piece reproduction by a user, individual ones of the event data of the music piece sequence data file from the first storage section in accordance with the corresponding time data, wherein, when an event data read out by said music piece sequence reproduction section is a user event data, said music piece reproduction section outputs a voice reproduction instruction for the selected voice data file allocated by the user event data;

a musical sound source section that generates a tone signal in accordance with the musical performance event data read out by said music piece sequence reproduction section;

a voice reproduction section that, in response to the voice reproduction instruction outputted by said music piece sequence reproduction section, reads out voice data included in the selected voice data file; and a voice sound source section that generates a voice signal on the basis of the voice data read out by said voice reproduction section.

2. A voice/music piece reproduction apparatus as claimed in 1 wherein the voice reproduction instruction includes information specifying the selected voice data file stored in said second storage section.

3. A voice/music piece reproduction apparatus as claimed in 1 which further comprises:

a receiver that receives a program designed for allocating a desired voice data file to the user event data; and a program execution device that executes the program received by said receiver.

4. A voice/music piece reproduction apparatus as claimed in claim 3 wherein, during execution by said program execution device, said program interacts with the user so as to obtain the answer from the user and, in accordance with the answer, automatically determines which voice data file is to be allocated to which user event data.

5. A voice/music piece reproduction apparatus as claimed in claim 1 which further comprises a voice data file creation section that creates desired voice data contents in response to user's input operation and writes a voice data file composed of the created voice data contents into said second storage section.

6. A voice/music piece reproduction apparatus as claimed in claim 1 which further comprises:

a receiver that receives a program designed for causing a user to input desired voice data contents and causing a voice data file composed of the voice data contents, inputted by the user, to be stored in said second storage section; and a program execution device that executes the program received by said receiver.

7. A voice/music piece reproduction apparatus as claimed in claim 6 wherein said program causes the user to input desired voice data contents in corresponding relation to desired user event data, causes a voice data file composed of the voice data contents, inputted by the user, to be stored in said second storage section, and causes the allocation section to allocate the voice data file to desired user event data.

8. A voice/music piece reproduction apparatus as claimed in claim 6 wherein the voice data contents inputted by the user is given text data desired by the user.

9. A voice/music piece reproduction apparatus as claimed in claim 1 wherein the voice data included in the voice data files stored in said second storage section include text data, and said voice sound source section synthesizes an audio-like voice signal on the basis of the text data included in the voice data.

10. A voice/music piece reproduction apparatus as claimed in claim 1 wherein said first storage section and second storage section are implemented by a same storage medium.

11. A voice/music piece reproduction apparatus as claimed in claim 1 wherein the voice data included in said voice data files is data indicative of human voice.

12. A voice/music piece reproduction apparatus as claimed in claim 1 which is built in a portable phone or portable communication terminal.

13. A method for reproducing a voice and music piece using a storage medium storing a music piece sequence data file and a plurality of voice data files, said music piece sequence data file being composed of a plurality of event data indicative of various control events and time data indicative of respective generation timing of the control events, said plurality of event data including musical performance event data and user event data, said method comprising:

an output step of outputting inquiry data to invite a user to answer an inquiry;

an allocation step of selecting a voice data file from among the voice data files stored in the storage medium in accordance with an answer from the user, and allocating the selected voice data file to the user event data in the music piece sequence data file;

a music piece sequence reproduction step of starting to read out, in response to an instruction of music piece reproduction by a user, individual ones of the event data of the music piece sequence data file from said storage medium in accordance with the corresponding time data, and, when an event data read out by said music piece reproduction step is a user event data, outputting a voice reproduction instruction for the selected voice data file allocated by the user event data; and a voice reproduction step of, in response to the voice reproduction instruction outputted by said music piece sequence reproduction step, reading out voice data included in the selected voice data file, wherein a tone signal is generated in accordance with the musical performance event data readout by said music piece sequence reproduction step, and a voice signal is generated on the basis of the voice data read out by said voice reproduction step.

14. A method as claimed in claim 13 which further comprises a voice data file creation step of creating desired voice data contents in response to user's inPut operation and writing a voice data file composed of the created voice data contents into said storage media.

15. A method as claimed in claim 13 wherein the voice data included in said voice data files is data indicative of human voice.

16. A program, embodied on a computer readable medium, containing a group of instructions for causing a computer to perform a method for reproducing a voice and music piece using a storage medium storing a music piece sequence data file and a plurality of voice data files, said music piece sequence data file being composed of a plurality of event data indicative of various control events and time data indicative of respective generation timing of the control events, said plurality of event data including musical performance event data and user event data, said method comprising:

an output step of outputting inquiry data to invite a user to answer an inquiry;

an allocation step of selecting a voice data file from among the voice data files stored in the storage medium in accordance with an answer from the user, and allocating the selected voice data file to the user event data in the music piece sequence data file;

a music piece sequence reproduction step of starting to read out, in response to an instruction of music piece reproduction by a user, individual ones of the event data of the music piece sequence data file from said storage medium in accordance with the corresponding time data, and, when an event data read out by said music piece reproduction step is a user event data, outputting a voice reproduction instruction for the selected voice data file allocated by the user event data; and a voice reproduction step of, in response to the voice reproduction instruction outputted by said music piece sequence reproduction step, reading out voice data included in the selected voice data file, wherein a tone signal is generated in accordance with the musical performance event data read out by said music piece sequence reproduction step, and a voice signal is generated on the basis of the voice data read out by said voice reproduction step.

17. A program as claimed in claim 16 wherein said method further comprises a voice data file creation step of creating desired voice data contents in response to user's input operation and writing a voice data file composed of the created voice data contents into said storage media.

18. A program as claimed in claim 16 wherein the voice data included in said voice data files is data indicative of human voice.

19. A program as claimed in claim 16 which is suitable for execution by a computer built in a portable phone or portable communication terminal.

* * * * *